US007377847B2

(12) United States Patent
Irie

(10) Patent No.: US 7,377,847 B2
(45) Date of Patent: May 27, 2008

(54) COIN RECEIVING AND DISBURSING APPARATUS

(75) Inventor: Yasuo Irie, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 68 days.

(21) Appl. No.: 11/336,733

(22) Filed: Jan. 20, 2006

(65) Prior Publication Data

US 2006/0199489 A1 Sep. 7, 2006

(30) Foreign Application Priority Data

Jan. 28, 2005 (JP) ..... 2005-022260

(51) Int. Cl.
*G07D 1/00* (2006.01)

(52) U.S. Cl. ..... 453/18

(58) Field of Classification Search ..... 453/18
See application file for complete search history.

(56) References Cited

U.S. PATENT DOCUMENTS 4,586,522 A * 5/1986 Taipale et al. ..... 453/10
5,711,704 A * 1/1998 Hughes et al. ..... 453/57
6,193,599 B1 * 2/2001 Kurosawa et al. ..... 453/57

FOREIGN PATENT DOCUMENTS

JP 3139697 12/2000

* cited by examiner

*Primary Examiner*—Patrick Mackey
*Assistant Examiner*—Mark Beauchaine

(57) ABSTRACT

The coin hopper has a rotational disc that is attached to a rotational axis protruding from a base that incorporates a drive unit. A retaining bowl is attached to the base to allow coins to be dispensed one by one by a rotational disc located in a circular cavity defined by a lower part of the retaining bowl. Slopes are formed in the base around the rotational disc so as to be point-symmetric about a rotational axis. A complementary slope corresponding to the base slopes is formed in at least a part of the retaining bowl, and the retaining bowl is attached to the base while these slopes are in contact with each other to enable alignment.

16 Claims, 7 Drawing Sheets

COIN RECEIVING AND DISBURSING APPARATUS

CROSS-REFERENCE TO RELATED APPLICATION

This application is based on application number 2005-022260 filed in Japan on Jan. 28, 2005 from which priority is claimed.

BACKGROUND OF THE INVENTION

1. Field of the Invention

The present invention relates to a coin hopper that dispenses coins one by one by means of a rotational disc. More specifically, it relates to a coin hopper that allows easy attachment and detachment of a retaining bowl for retaining coins.

2. Description of Related Art

Coin hoppers are used in automatic teller machines, coin dispensers, game machines and other devices. A typical coin hopper includes a base, a detachable retaining bowl for holding coins and a rotating disc for dispensing coins. A "jamming phenomenon" sometimes occurs when a coin is sandwiched between the base and the rotating disc, thereby locking the disc. When this occurs, the retaining bowl must be detached from the base, the coins are removed from the retaining bowl, and the rotating disc detached to permit the jammed coin to be removed. Thereafter, the rotating disc and the retaining bowl are reattached to restore the coin hopper to an operational state. In these circumstances, various conventional designs have been proposed to permit detachment of the retaining bowl.

Conventional hoppers often feature a first latch on the retaining bowl that attaches to the base and a second latch that may include a spring that also attaches to the base. The retaining bowl is positioned and fixed with respect to the rotating disc by the first and the second latches. When the first and the second latches are poorly aligned, the retaining bowl is not properly positioned, leading to the possibility that the rotating disc will contact the retaining bowl. In addition, since the second latch is attached by a spring, it is necessary to make the spring force large enough to prevent the retaining bowl from vibrating during operation, further complicating attachment and detachment of the retaining bowl. If the spring force is reduced to make detachment easier, the retaining bowl may vibrate during operation reducing the expected life the hopper.

Thus, the industry is still seeking improvements in removably attaching a retaining bowl in coin dispensing apparatus.

SUMMARY OF THE INVENTION

It is a first object of the present invention to allow attachment of the retaining bowl to the base without concern that a rotating disc will contact the retaining bowl during operation.

A second object is to allow attachment and detachment of the retaining bowl to the base in a relatively simple operation.

A third object is to meet the first two objects at an economical low cost.

According to the present invention, the foregoing and other objects are obtained by a coin receiving and disbursing apparatus described in this disclosure.

To achieve the above objects, a coin hopper is configured as follows. The coin hopper has a rotational disc that is attached to a rotational axis protruding from a base that incorporates a drive unit, a retaining bowl is attached to the base and allows coins to be dispensed one by one by a rotational disc located in a circular cavity defined by a lower part of the retaining bowl. Slope configurations are formed in the base around the rotational disc so as to be point-symmetric about the rotational axis. A complementary slope corresponding to the base slopes is formed in at least a part of the retaining bowl, and the retaining bowl is attached to the base while these slopes are in contact with each other.

In this configuration, when the retaining bowl is attached to the base, the complementary slope of the retaining bowl comes into contact with the slopes provided in the base, so that the retaining bowl can be moved while restricted by these slopes. Since the slopes of the base are disposed point symmetrically about the rotational axis, the slope of the retaining bowl is guided by the slopes of the base. In other words, the retaining bowl is guided in a point symmetric manner with respect to the rotational axis of the rotational disc, thereby allowing the circular hole of the retaining bowl to be automatically aligned with the rotational disc. The retaining bowl is fixed in an aligned condition. This is advantageous in that the rotational disc will not come into contact with the retaining bowl even when the retaining bowl is attached to the base without special care. In addition, when the retaining bowl is forced in a lateral direction, the retaining bowl is supported by the slope so that any force is transmitted to the base, and not to the attachment device. This allows the retaining bowl to remain in a fixed position. Furthermore, even when there is a gap between the base and the retaining bowl, the gap is limited between the slopes, thereby minimizing oscillation and vibration.

The invention may be characterized by slopes in the base that extend outward in a ring shape about the rotational axis, while the complementary slope of the retaining bowl is an inward slope. In this arrangement, the slopes of the base are outward slopes that form a ring-like receiving part centered at the rotational axis of the rotational disc. An additional advantage of this configuration is that the ring-like receiving part can be used as a guide for a coin pushed by the rotational disc. Further, since the slope of the retaining bowl is an inward slope formed in an inner surface of the circular hole, it reduces the possibility of damage even when other parts are hit during removal from the base.

The invention may also feature the contacting portion between the slope belonging to the base and the complementary slope belonging to the retaining bowl being located adjacent to the peripheral surface of the rotating disc. Since the contact portion between the slope belonging to the base and the slope belonging to the retaining bowl corresponds to the peripheral surface of the rotating disc, coins in the retaining bowl will not come into contact with the contacting portion. Therefore, when a discontinuity is present due to any slight deviation of the contacting portion, it will not have an adverse effect on the coins.

The invention may also be configured to have a retaining bowl attached to the base by means of a one-touch attachment device. An additional advantage is that when the retaining bowl is aligned at its circular hole with the rotating disc by means of the automatic aligning mechanism achieved by the outward slopes and the inward slope as described above, it may be readily and securely attached to the base by means of the one-touch attachment device.

The present invention can alternatively have a first attachment unit and a second attachment unit, with the first attachment unit and the second attachment unit featuring hooks that are perpendicular to each other. Thus the movement of the retaining bowl with respect to the base is restricted in the right and left direction by the hook of the first attachment unit, and in the fore-and-aft direction by the hook of the second attachment unit. Because the retaining bowl is fixed to the base while restricted in the fore-and-aft and right and left directions with respect to the base, the retaining bowl can be securely affixed to the base.

In still another possible embodiment the hook may be elastically latched attached to the base allowing easy attachment and detachment of the retaining bowl.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
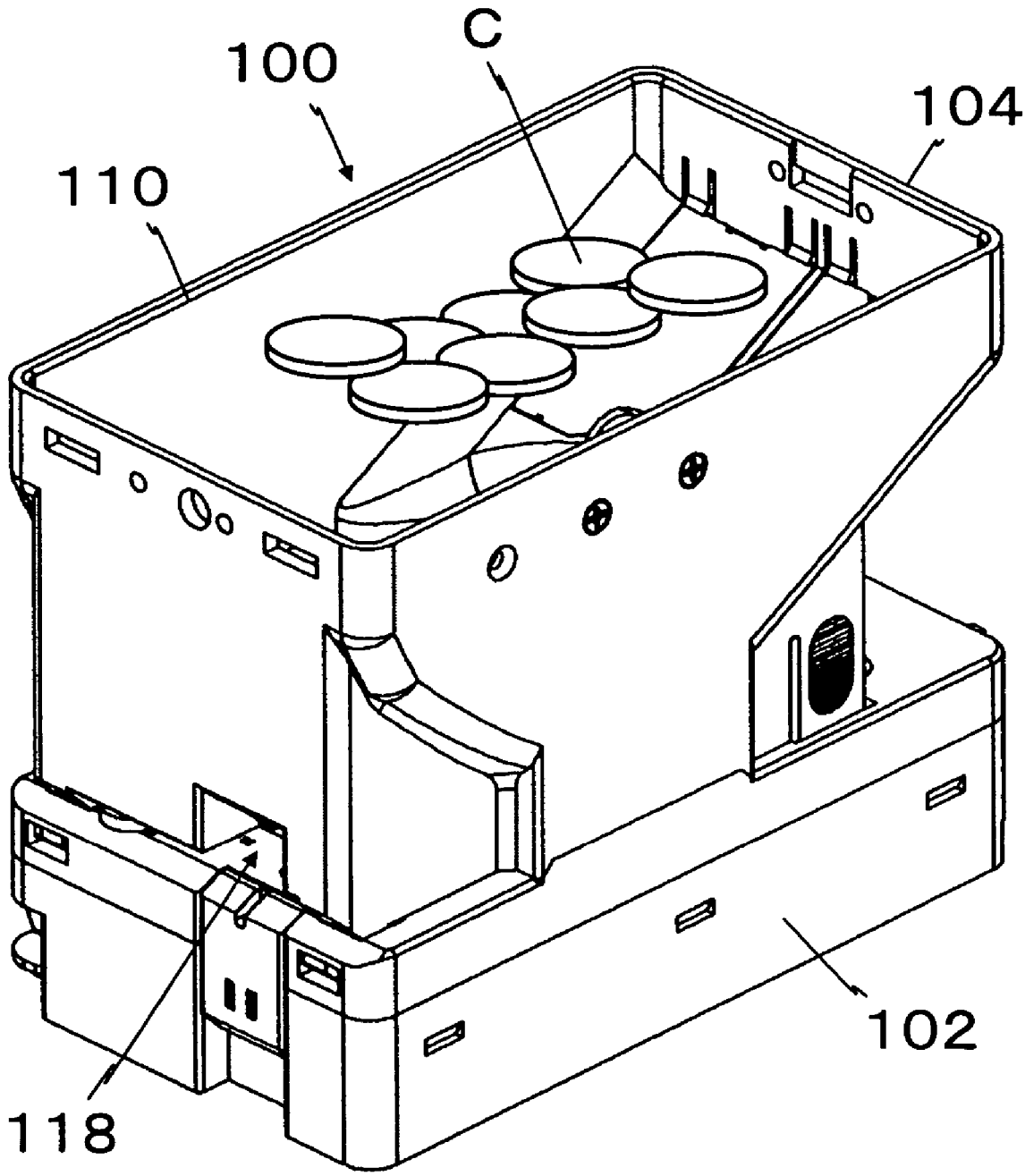
FIG. 1 is a perspective view of a coin hopper embodying the present invention.
Figure 2:
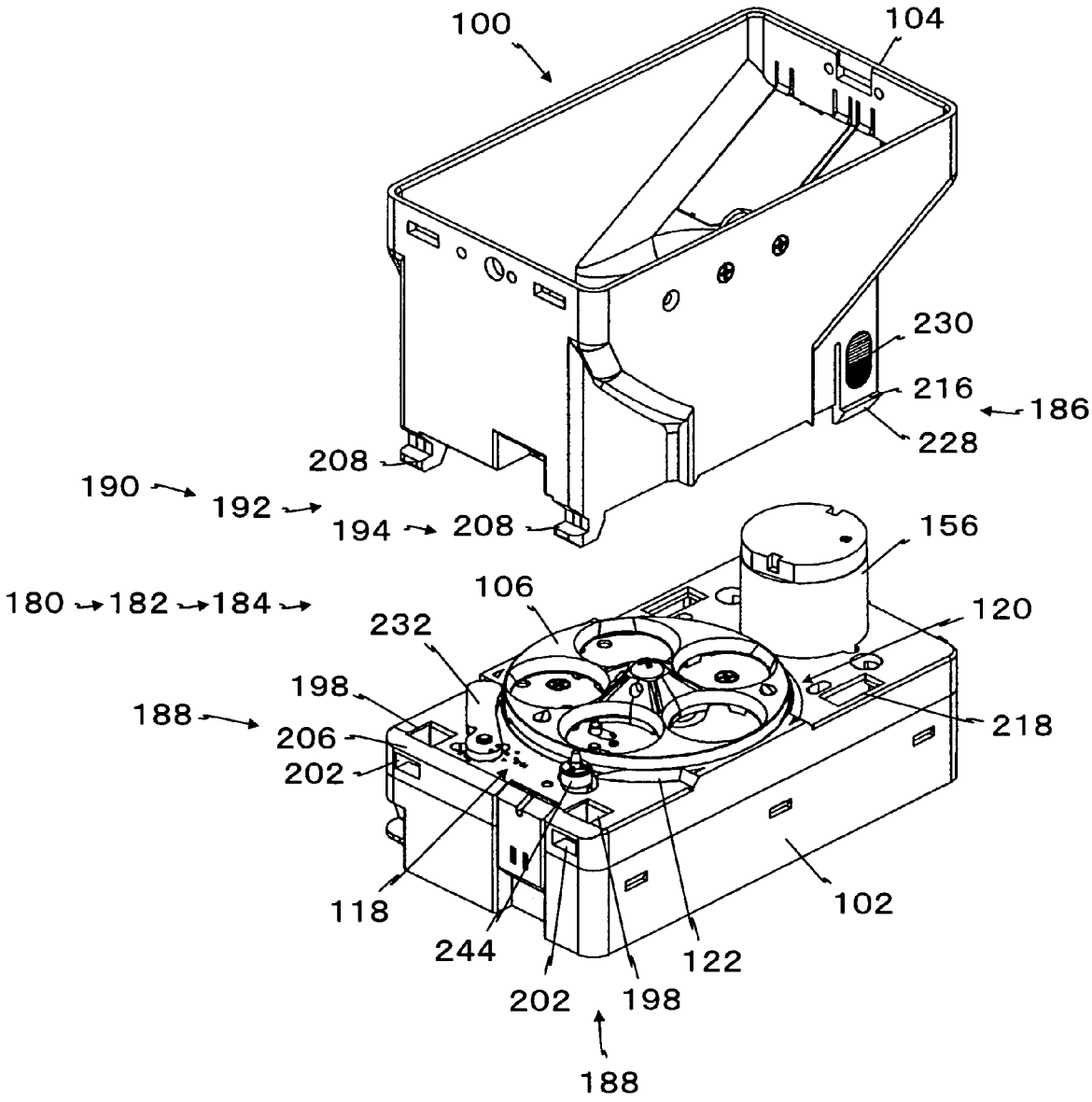
FIG. 2 is an exploded perspective view of a coin hopper embodying the present invention.
Figure 3:
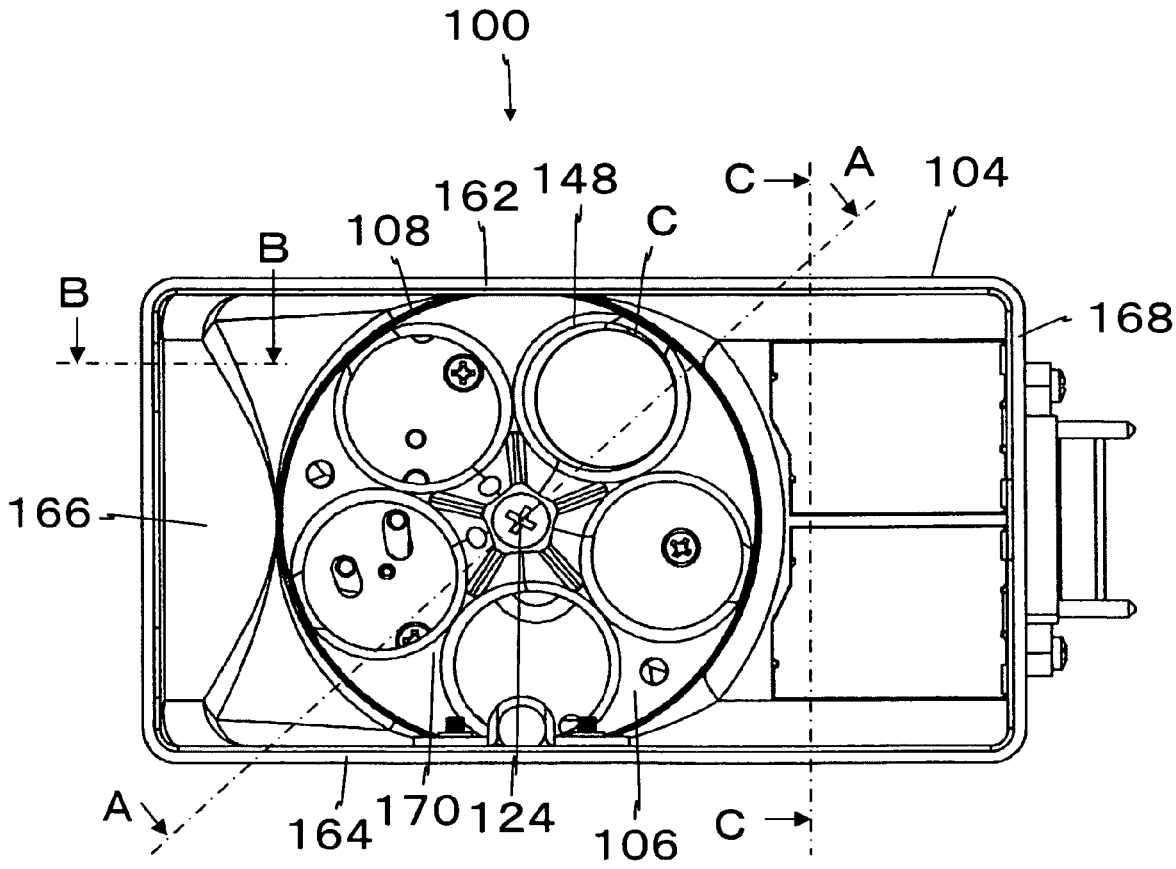
FIG. 3 is a plan view of a coin hopper embodying the present invention.
Figure 5:
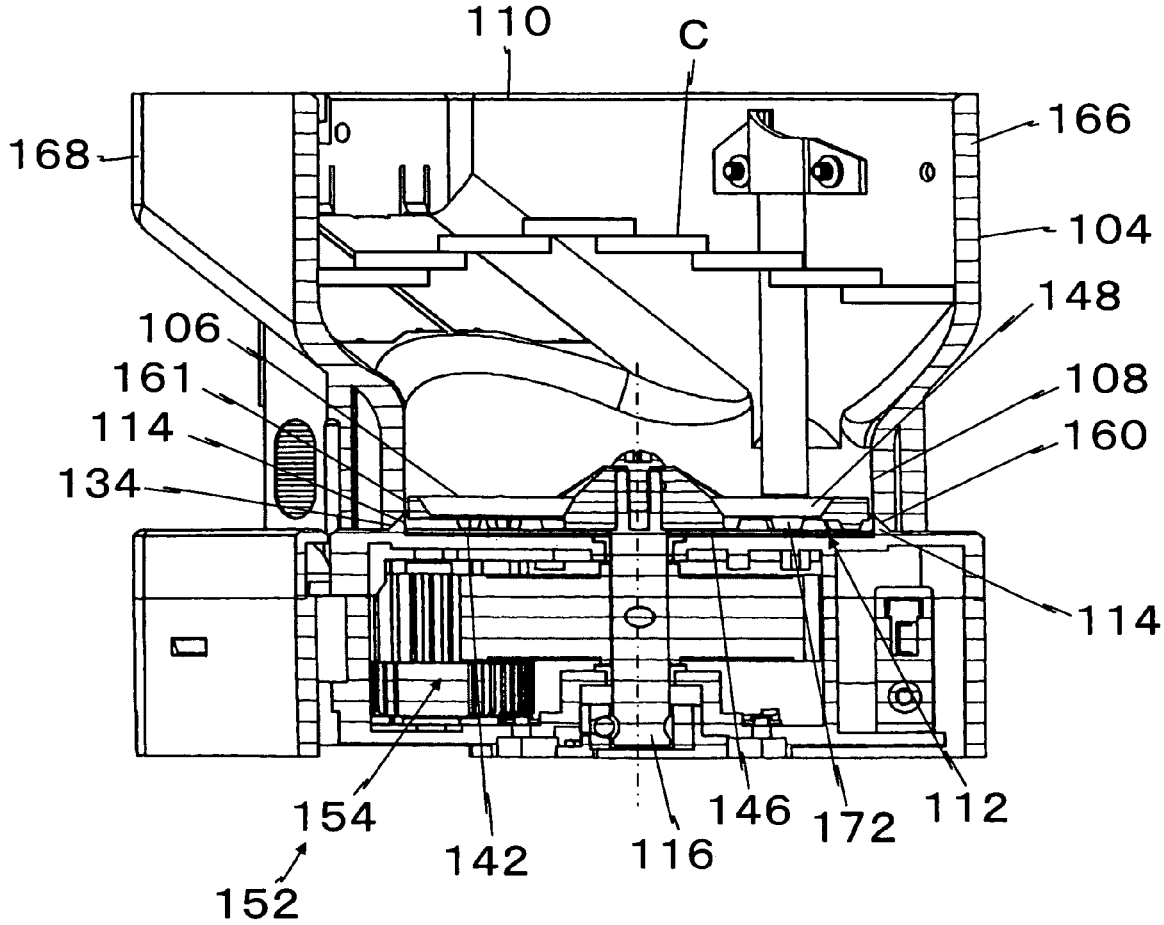
FIG. 5 is a cross section view taken along the line A-A in FIG. 3.

In FIG. 1, a coin hopper 100 includes a rectangle base 102, a retaining bowl 104 disposed above the base 102, and a rotational disc 106. As shown in FIGS. 3 and 5, the retaining bowl 104 has a lower end which defines a circular hole 108, a rectangular upper opening 110, and an intermediate part along the fore-and-aft direction extending from the circular hole 108 to the upper opening 110 formed by a slant wall and a vertical wall.

First, the base 102 will be explained with reference to FIGS. 4 and 5. The base 102 incorporates a driving unit 152 for the rotational disc 106, and receives the retaining bowl 104 attached thereto in a detachable manner. As shown in FIG. 5, on the top face of the base 102, a circular recess 112 is formed. On the circumference of the circular recess 112 is formed a ring-like receiving part 114 whose cross section along almost the entire circumference is triangular, having a height slightly larger than a coin thickness. The receiving part 114 is disposed on a circle centered at a rotational axis 116 protruding from the base 102.

More specifically, the receiving part 114 is located on the opposite side of a dispensing port 118 as will be explained later, and includes a semicircular first receiving part 120 and a second receiving part 122 on the lateral side of the dispensing port 118. The first receiving part 120 and the second receiving part 122 are located point-symmetrically about the center of 124 of the rotational axis 116.

Figure 4:
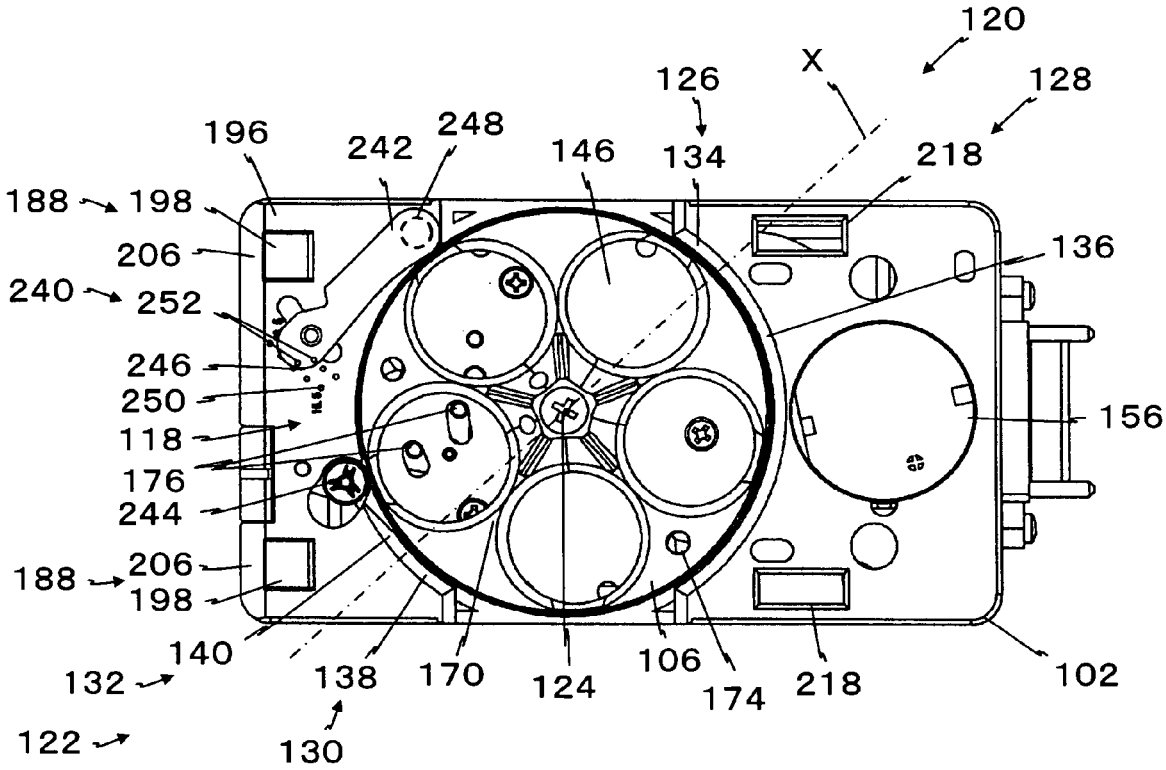
FIG. 4 is a plan view showing a coin hopper embodying the present invention without a retaining bowl.

The first receiving part 120, a first arc portion 126 and a second arc portion 128 are disposed on a line symmetrically with respect to a line X passing through the center 124 of the rotational disc 106, and in the second receiving part 122, a third arc portion 130 and a fourth arc portion 132 are disposed on a line symmetrically with respect to the line X shown in FIG. 4. The first arc portion 126 has a first outward slope 134, a second arc portion 128 has a second outward slope 136, a third arc portion 130 has a third outward slope 138, and a fourth arc portion 132 has a fourth outward slope 140.

These outward slopes 134, 136, 138 and 140 are sloped outwardly and upwardly. In other words, the outward slopes 134, 136, 138 and 140 are parts of a triangular pyramid having its apex at a point on an upward line extending from the center of rotational axis 124.

The rotational axis 116 is rotatably disposed about an axial line which is substantially perpendicular to the center of a bottom face 142 of the circular recess 112. On the bottom face 142, a sliding plate 146 formed from a circular metal plate is fitted and fixed. The rotational axis 116 is rotated by an electric motor 156 fixed to the base 102 via a decelerating mechanism 154 which is a driving unit 152 disposed in the base 102.

Next, the retaining bowl 104 will be explained with reference to FIG. 5. The retaining bowl 104 retains a plurality of coins in bulk, and guides them to the rotational disc 106. The circular hole 108 formed in a lower part of the retaining bowl 104 has a tapered inner surface at its lower end. The inner surface in the lower end is an inward slope 160 which is sloped in and down at the same angle of inclination with the outward slopes 134, 136, 138 and 140, making contact with the outward slopes.

When the inward slope 160 is brought into pressure contact with the outward slopes 134, 136, 138 and 140, the circular hole 108 of the retaining bowl 104 is automatically shifted to a position centered at the center 124 of the rotational axis 116. The circular hole 108 is automatically aligned by outward slopes 134, 136, 138 and 140 and inward slope 160.

This is because when the inward slope 160 is positioned closer to the dispensing port 118 than a proper position in FIG. 4, for example, the inward slope 160 is out of contact with the first outward slope 134, the third outward slope 138 and the fourth outward slope 140, while it is in contact with the second outward slope 136; therefore, the retaining bowl 104 is shifted right in FIG. 4 under the guidance by the second outward slope 136, and the retaining bowl 104 is shifted by these slopes so that the first to fourth outward slopes 134 to 140 contact the inward slope 160 at equal contact pressure.

The center of rotational axis 124 of the rotational disc 106 is substantially aligned with the center of the circular hole 108 automatically. The upper part of the rotational disc 106 is situated inside the circular hole 108. The phrase "rotational disc situated below the retaining bowl" also includes embodiments where the entire rotational disc 106 is situated in the circular recess 112. It involves the case where the rotational disc 106 is situated inside the circular hole 108 or directly below the circular hole 108 of the retaining bowl 104.

When the first to fourth outward slopes 134 to 140 are formed in a ring-shape receiving part 114, the receiving part 140 serves also as a coin guide as will be explained later. This is advantageous in producing a low cost hopper.

Preferably, inner contact portions between the outward slopes 134, 136, 138 and 140 and the inward slope 160 correspond to the peripheral surface 161 of the rotational disc 160 as shown in FIG. 5. In other words, these contact portions are situated at the midpoint along the thickness direction of the rotational disc 106. The coins stirred by the rotational disc 106 as will be described later will not come into contact with these inner contact portions. This provides the advantage that an end part of a slope will not be damaged by stirred coins, even when the contact portions are misaligned at the time of attachment.

The retaining bowl 104 has a first lateral wall 162 and a second lateral wall 164 that extend substantially vertically in the upward direction from the circular hole 108 to the upper opening 110. A third lateral wall 166 inclines at an acute angle from the circular hole 108 toward the upper opening 110, and then extends upward substantially vertically. A fourth lateral wall 168 inclines at a relatively gentle angle from the circular hole 108, and then extends substantially upward. These angles of inclination allow a coin placed thereon to slide by its own weight.

Next, the rotational disc 106 will be explained with reference to FIGS. 3 and 5. The rotational disc 106 stirs a coin in the retaining bowl, and feeds out the coin to a later-described dispensing device 240 after sorting the coin. The rotational disc 106 has a plurality of through holes 148 on the circle centered at the rotational axis 116 at a certain interval. A lower part, having at least a push projecting strip 172 is situated in the circular recess 112. On the bottom face of a rib 170 between the through holes 148 of the rotational disc 106, the push projecting strip 172 extending circumferentially from the center part is formed.

On the top face of the periphery of the rotational disc 106, a stirring projection 174 in the shape of a triangular pyramid may be formed. Therefore, a peripheral surface 191 of the rotational disc 106 means a part corresponding to the thickness of only the rotational disc 106 without the push projecting strip 172 and the stirring projection 174.

Next, an attachment device 180 for attaching the retaining bowl 140 to the base 102 will be explained. The attachment device 180 detachably fixes the retaining bowl 104 to the base 102. The attachment device 180 of the present embodiment is a one-touch attachment device 182. The one-touch attachment device 182 enables the retaining bowl 104 to be attached/detached through at most two actions. The one-touch attachment device 182 consists of a first attachment unit 184 and a second attachment unit 186.

First, the first attachment unit 184 will be explained. The first attachment unit 184 principally positions the retaining bowl 104 at a certain position of the base 102. The first attachment unit 184 is composed of a latch portion 188 belonging to the base 102 and a hook portion 190 belonging to the retaining bowl 104.

Figure 6:
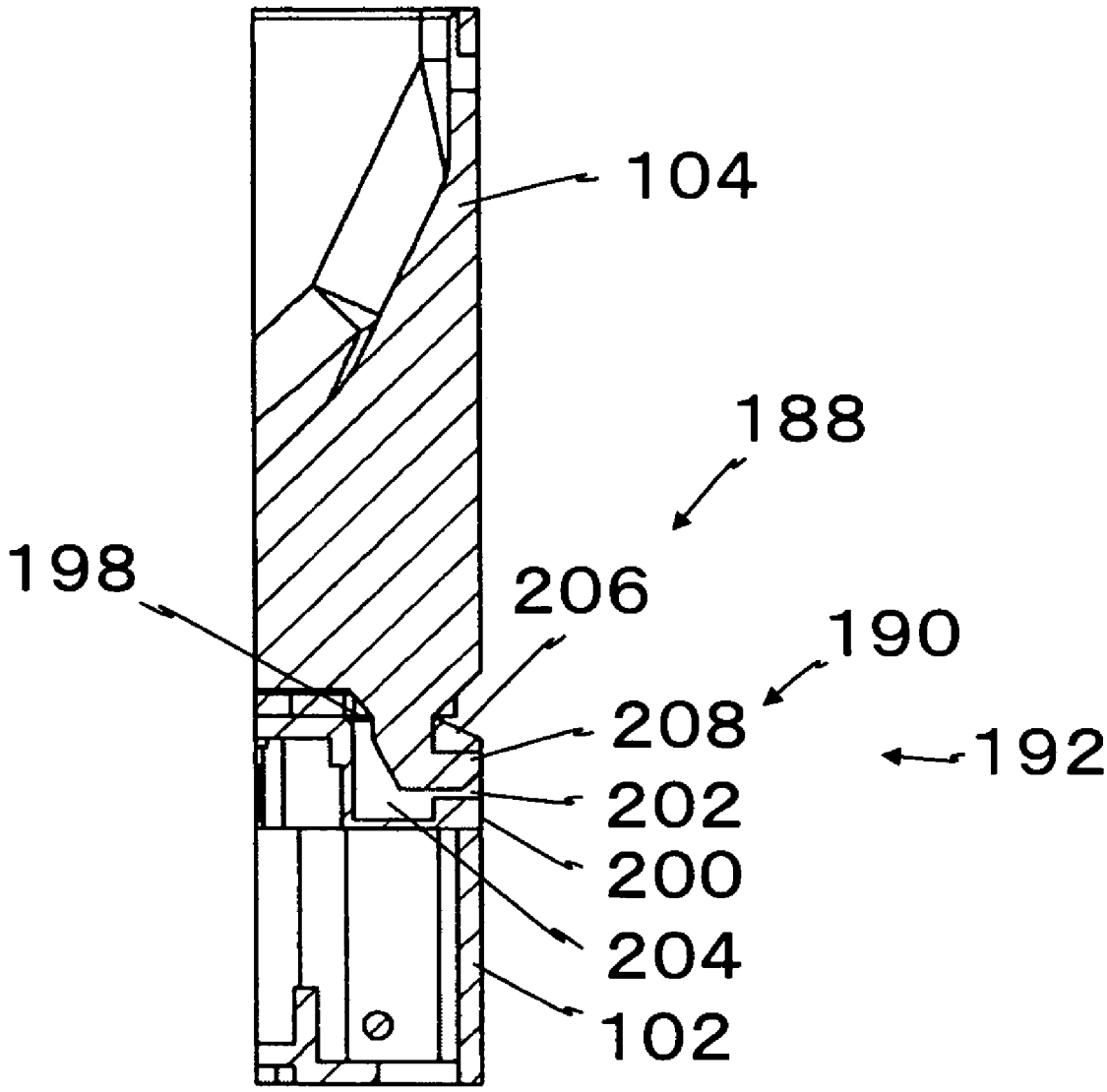
FIG. 6 is a cross section view taken along the line B-B in FIG. 3.

In this embodiment, the first attachment unit 184 includes a first pivot hook portion 192 and a second pivot hook portion 194 disposed, one either side of the dispensing port 118. However, either one of these pivot hooks may be provided. Since the first pivot hook portion 192 and the second pivot hook portion 194 have the same structure, the first pivot hook portion 192 will be representatively explained with reference to FIG. 6.

In the latch portion 188 of the first pivot hook portion 192, a rectangular insertion opening 198 that opens in a top face 196 of the base 102 and a latch opening 202 that opens in a lateral wall 200 of the base 102 are communicated by an angular passage 204. In this manner, a latching bar 206 is formed in the base 102.

Next, the hook portion 190 will be explained. In correspondence with the latching bar 206, the hook portion 190 is formed in a lower end part of the retaining bowl 104. The hook portion 190 is a hook 208 that extends downward, and then bends at a right angle to the horizontal direction. The retaining bowl 104 is allowed to pivot about the latching bar 206 while the hook 208 is latched to the latching bar 206.

Next, the second attachment unit 186 will be explained. The second attachment unit 186 principally hooks the retaining bowl 104 to the base 102 and keeps it in a fixed state. The second attachment unit 186 is composed of a latch portion 210 belonging to the base 102 and a hook portion 212 belonging to the retaining bowl 104.

In an alternative possible embodiment, the second attachment unit 186 can be a first elastic hook portion 214 disposed below the first lateral wall 162 and a second elastic hook portion 216 disposed below the second lateral wall 164, but either one of these hook portions alone may be provided. Since the first elastic hook portion 214 and the second elastic hook portion 216 have the same structure, the first elastic hook portion 214 will be representatively explained.

The latch portion 210 of the first elastic hook portion 214 is composed of a rectangular insertion opening 218 that opens in the top end face 196 of the base 102, and a key-shape latch portion 222 which is formed by notching the inner face of a lateral wall 220 of the base 102. The hook portion 212 is composed of a plate-like member 224 extending toward the base 102 generally vertically in the downward direction from the lateral side of the slope part of the first lateral wall 162, and a hook 226 formed in a lower end thereof and bending at a right angle outwardly. Since the hook portion 212 and the retaining bowl 104 are made of resin as a single unit, the plate-like member 224 has elasticity.

Figure 7:
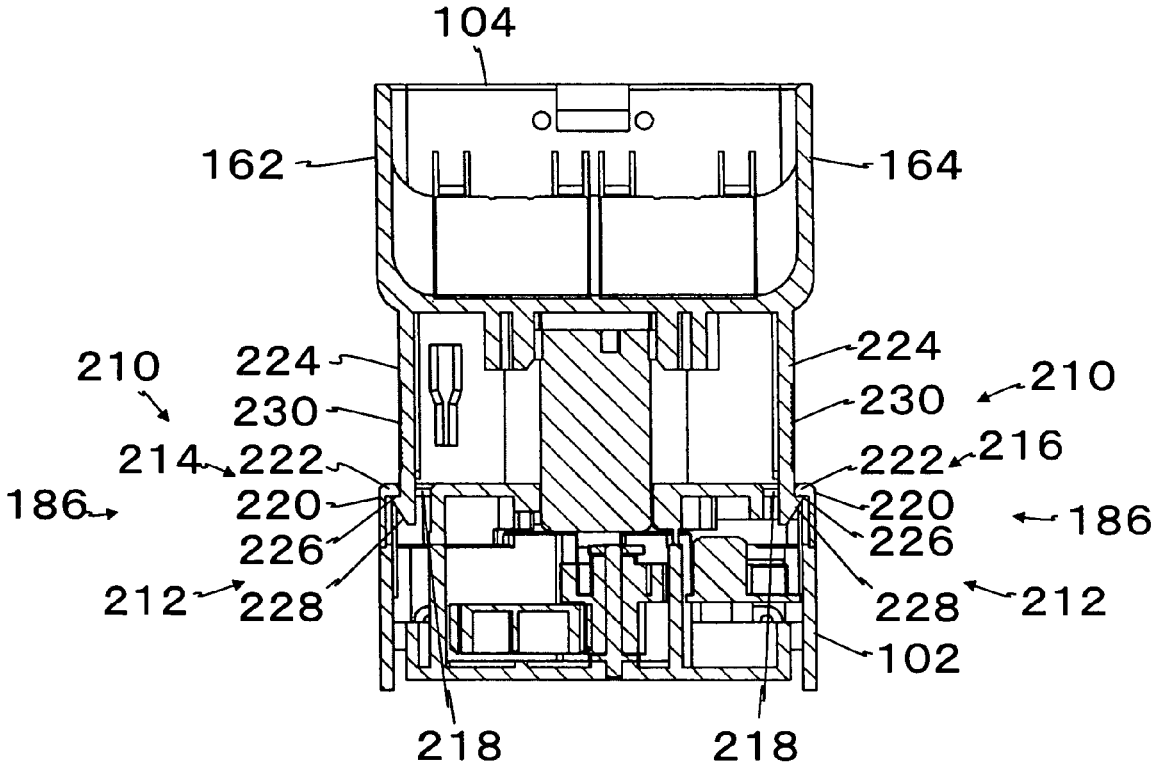
FIG. 7 is a cross section view taken along the line C-C in FIG. 3.

In a lower end part of the hook 226, a downward slope 228 is formed, and as the retaining bowl 104 is pivoted about the first attachment unit 184, the downward slope 228 is pushed laterally in FIG. 7 by an end edge of the insertion opening 218 so that the plate-like member 224 is deflected, resulting that the hook 226 enters inside the insertion opening 218. Then as the hook 226 completely enters inside the insertion opening 218, the plate-like member 224 is restored by its own elasticity, and the hook 226 is hooked into the key-shape latch portion 222.

The key-shape latch portion 222 extends in the direction perpendicular to the latching bar 206. In other words, movement in one direction of the retaining bowl 104 is restricted by the latching bar 206, movement in the direction perpendicular to the one direction is restricted by the key-shape latch portion 222, and movement in the escaping direction is restricted by the latching bar 206 and the key-shape latch portion 222. Therefore, the retaining bowl 104 is prevented from moving in the fore-and-aft, right and left, and upward directions with respect to the base 102, so that it is firmly fixed to the base 102.

By deflecting the plate-like members 224 of the first elastic hook portion 214 and the second elastic hook portion 216 so as to come close to each other, the hook 226 can be drawn out through the insertion opening 218 after removal of the hook 226 from the key-shape latch portion 222. Further, by drawing the hook 208 out of the insertion opening 198, it is possible to remove the retaining bowl 104 from the base 102.

Preferably, an antislip part 230 in which a plurality of V-shaped grooves are provided in parallel is formed on the outer surface of the plate-like member 224. This prevents fingers from slipping when a thumb and other fingers hold the first elastic hook portion 214 and the second elastic hook portion 216.

Next, the coin dispensing device 240 will be explained with reference to FIG. 4. The dispensing device 240 vigorously tosses a coin that is pushed out in the radial direction of the rotational disc 106 by the push projecting strip 172 of the rotational disc 106, in the same direction. The dispensing device 240 includes a rectangular guide plate 242 provided near the periphery of the rotational disc 106, and a flipping roller 244 provided near the periphery of the rotational disc and biased so as to come close to the guide plate 242.

The flipping roller 244 is stopped by a stopper (not illustrated) at a distance which is slightly smaller than the diameter of the coin from a tip end of the guide plate 242 and in a stationary state. Therefore, the dispensing port 118 is defined between a tip end 246 of the guide plate 242 and the flipping roller 244.

When the coin is pushed out by the push projecting strip 172 of the rotational disc 106, the coin comes into contact with the flipping roller 244 under the guidance by the guide plate 242. The flipping roller 244 is moved by the coin, and directly after passage of the diameter of the coin, it flips the coin by its biasing force. By directly or indirectly detecting the movement of the flipping roller 244, it is possible to detect the dispensing of a coin one by one.

The guide plate 242 is pivotable about a spindle 248 so as to adapt to changes in coin size, and is fixed to the base 102 by a fixing device (not illustrated) at a certain position. For convenience of position adjustment of the guide plate 242, a mark 250 is added to the top face 196 of the base and a mark 252 is added to the guide plate 242.

Next, an attachment/detachment operation of the retaining bowl 104 to the base 102 will be explained. First of all, after inserting the hook 208 belonging to the retaining bowl 104 into the insertion opening 198 of the latch portion 188 formed in the base 102 in the condition that the retaining bowl 104 is inclined, it is shifted in the horizontal direction so that the hook 208 is hooked into the latching bar 206. Next, the retaining bowl 104 is caused to pivot about the latching bar 206, whereby the hook 226 is inserted into the insertion opening 218 of the base 102.

In the course of the insertion, since the downward slope portion 228 comes into contact with a edge part of the insertion opening 218, the plate-like members 224 thereof are elastically deformed so as to come close to each other. Upon further pushing, the downward slope portion 228 comes off the edge part of the insertion opening 218, so that the plate-like members 224 are elastically restored and each hook 226 moves below the key-shaped latch portion 222.

As a result, the retaining bowl 104 is fixed to the base 102 by means of the first attachment unit 184 and the second attachment unit 186. In the course of hooking, the inward slope 160 of the retaining head 104 is guided while it comes into contact with the fourth outward slope 140, the third outward slope 138, the first outward slope 134 and the second outward slope 136 in this order.

At this time, the first outward slope 134 and the second outward slope 136, and the third outward slope 138 and the fourth outward slope 140 are respectively situated in line symmetrical relation with respect to a certain line X that passes through the center of rotational axis 124. Therefore, when the retaining bowl 104 is pushed and shifted in a substantially vertical downward direction with respect to the base 102, the inward slope 160 in contact with these slopes 134, 136, 138 and 140 is moved so that it receives equal power in the vertical and horizontal directions with regard to the line X in FIG. 4.

In other words, as a result of guiding the retaining bowl 104 so that the circular hole 108 and the receiving part 114 are concentric, the center of the circular hole 108 is automatically made into substantially coincidence with the center of rotational axis 124 of the rotational disc 106. For detachment of the retaining bowl 104, one may put his/her thumb on the antislip part 230 of one of the plate-like members 224, and put another finger on the antislip part 230 of the other of the plate-like members 224, and cause deformation so that these plate-like members 224 come closer to each other. As a result, the hook 226 comes off the key-shape latch portion 222.

In the condition that the hook 226 comes off, the hook 226 is drawn out from the insertion opening 218, and by drawing out the hook 208 from the insertion opening 198 by pivoting the retaining bowl 104 upward about the latching bar 206, it is possible to remove the retaining bowl 104 from the base 102.

In the above embodiment, outward slopes are formed in the base, and the inward slope is formed in the retaining bowl, however, an inward slope may be formed in the base and an outward slope may be formed in the retaining bowl.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin hopper comprising:

a rotational disc attached about a rotational axis extending from a base having a first receiving part and a second receiving part, the first and second receiving parts are spaced diametrically apart from each other;

a drive unit for driving a rotational disc;

a retaining bowl attached to the base and permitting the rotational disc to dispense coins from the retaining bowl;

wherein at least three base slopes are provided in the base relative to a diametric alignment between the spaced first and second receiving parts with at least one base slope positioned on one side of the diametric alignment on each of the first and second receiving parts and a third base slope is positioned on the other side of the diametric alignment around the rotational disc so as to be point-symmetric about the rotational axis for each of the at least three base slopes and at least one complementary slope corresponding to one of said base slopes is formed in the retaining bowl, such that when the retaining bowl is attached to the base, one of said base slopes is in contact with at least one complementary slope.

2. The coin hopper of claim 1 wherein the base slopes are outward slopes formed point-symmetrically in a receiving part that is ring shaped about the rotational axis, and the complementary slope of the retaining bowl is an inward slope that forms at least a part of an inner face defining a circular hole in a lower part of the retaining bowl.

3. The coin hopper of claim 1 wherein a contact portion between the slopes of the base and the complementary slope of the retaining bowl are adjacent to a periphery of the rotational disc.

4. The coin hopper of claim 1 wherein the retaining bowl is attached to the base by a one-touch attachment unit.

5. The coin hopper according to claim 4, wherein the one-touch attachment unit comprises a first attachment unit and a second attachment unit, and the first attachment unit and the second attachment unit are provided with hooks that are aligned opposite to each other.

6. The coin hopper according to claim 5, wherein one of the hooks is elastically latched to the base.

7. A coin hopper comprising:

a base housing having a first receiving part and a second receiving part, the first and second receiving parts are spaced diametrically apart from each other with at least three sloped surfaces defining an opening;

a motor in the base housing;

a shaft coupled with the motor;

a disc coupled to the shaft located within the opening for dispensing coins; and a removable container with a complementary surface, that mates with at least one of the sloped surfaces of the base housing wherein at least three sloped surfaces are provided in the base relative to a diametric alignment between the spaced first and second receiving parts with at least one sloped surface positioned on one side of the diametric alignment on each of the first and second receiving parts and a third sloped surface positioned on the other side of the diametric alignment around the disc so as to be point-symmetric about a rotational axis for each of the at least three sloped surfaces and at least one complementary slope corresponding to one of said sloped surfaces is formed in the removable container, such that when the removable container is attached to the base, one of said base slopes is in contact with at least one complementary slope.

8. The coin hopper of claim 7 wherein a circumference of the disc and an edge of the housing defining the opening are nearly coplanar.

9. The coin hopper of claim 7 wherein the sloped surface of the housing slopes away from the opening.

10. The coin hopper of claim 7 further comprising means for attaching the housing to the container.

11. The coin hopper of claim 7 further comprising a fastener for connecting the base housing and an unmovable container.

12. The coin hopper of claim 11 wherein the fastener is coupled to the base housing with an elastic member.

13. In a coin dispensing apparatus having a base with a rotary disc for selectively dispensing coins, the improvement of a removable coin hopper assembly comprising a coin hopper having an opening for extending around the rotary disc to enable coins to contact the rotary disc;

a plurality of at least three base sloping surfaces positioned on the base, the base having a first receiving part and a second receiving part, the first and second receiving parts are spaced diametrically apart from each other; and a complementary plurality of sloping surfaces on the coin hopper for contacting each of the base sloping surfaces and aligning the coin hopper on the base wherein the three base sloping surfaces are provided in the base relative to a diametric alignment between the spaced first and second receiving parts with at least one base sloping surface positioned on one side of the diametric alignment on each of the first and second receiving parts and a third base sloping surface is positioned on the other side of the diametric alignment around the rotary disc so as to be point-symmetric about the rotational axis for each of the at least three base sloping surfaces and at least one complementary slope corresponding to one of said base slopes is formed in the coin hopper, such that when the coin hopper is attached to the base, each of said base sloping surfaces are in contact with respective complementary sloping surfaces on the coin hopper.

14. The coin dispensing apparatus of claim 13 further including a first attachment unit having an aperture on one of the coin hopper and base and a hook member configured to pivotally enter the aperture on the other one of the coin hopper and base for securing the coin hopper to the base.

15. The coin dispensing apparatus of claim 14 further including a second attachment unit for locking the coin hopper and base together.

16. The coin dispensing apparatus of claim 15 further including an elastic hook member that engages the aperture.

* * * * *